US006918379B2

(12) United States Patent
Reischl et al.

(10) Patent No.: US 6,918,379 B2
(45) Date of Patent: Jul. 19, 2005

(54) METHOD AND CONTROL AND REGULATING DEVICE FOR OPERATING AN INTERNAL COMBUSTION ENGINE WITH PIEZOELECTRICALLY ACTUATED FUEL INJECTION VALVES

(75) Inventors: Rolf Reischl, Stuttgart (DE); Klaus Joos, Walheim (DE); Thomas Frenz, Noerdlingen (DE); Klaus Mueller, Asperg (DE); Markus Amler, Leonberg-Gebersheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/491,404

(22) PCT Filed: Jul. 26, 2002

(86) PCT No.: PCT/DE02/02785

§ 371 (c)(1),
(2), (4) Date: Sep. 9, 2004

(87) PCT Pub. No.: WO03/031788

PCT Pub. Date: Apr. 17, 2003

(65) Prior Publication Data

US 2005/0016502 A1 Jan. 27, 2005

(30) Foreign Application Priority Data

Sep. 28, 2001 (DE) ..... 101 48 221

(51) Int. Cl.[7] ..... F02M 51/00
(52) U.S. Cl. ..... 123/480
(58) Field of Search ..... 123/478, 479, 123/480, 482, 445, 434, 395, 90.11

(56) References Cited

U.S. PATENT DOCUMENTS 5,816,220 A 10/1998 Stumpp et al.

FOREIGN PATENT DOCUMENTS

| | | |
|---|---|---|
| DE | 19604552 | 8/1997 |
| DE | 19711903 | 9/1998 |
| DE | 19719631 | 9/1998 |
| DE | 19810525 | 9/1999 |
| DE | 19854306 | 6/2000 |

*Primary Examiner*—Bibhu Mohanty
(74) *Attorney, Agent, or Firm*—Kenyon & Kenyon

(57) ABSTRACT

In an internal combustion engine, the fuel enters at least one combustion chamber of the internal combustion engine via at least one fuel injection device. A piezoelectric actuator moves a valve element of the fuel injection device. The function of the piezoelectric actuator is monitored and a malfunction is detected. To minimize the risk of damage to the internal combustion engine in the event of a malfunction of the piezoelectric actuator, the fuel mass flow to the fuel injection device is reduced if a malfunction of the piezoelectric actuator is detected.

9 Claims, 3 Drawing Sheets

METHOD AND CONTROL AND REGULATING DEVICE FOR OPERATING AN INTERNAL COMBUSTION ENGINE WITH PIEZOELECTRICALLY ACTUATED FUEL INJECTION VALVES

FIELD OF THE INVENTION

The present invention first relates to a method for operating an internal combustion engine in which the fuel directly enters at least one combustion chamber of the internal combustion engine via at least one fuel injection device whose valve element is moved by a piezoelectric actuator and in which the function of the piezoelectric actuator is monitored and a malfunction is detected.

BACKGROUND INFORMATION

A method is described in German Patent Application No. DE 198 54 306. In this patent application, a fuel injection device is described, which includes a piezoelectric actuator and which is installed in an internal combustion engine having gasoline direct injection (GDI). In an internal combustion engine of this type, a separate fuel injection device is assigned to each combustion chamber. It is possible to inject the fuel into the corresponding combustion chamber of the internal combustion engine via the fuel injection device in such a way that the fuel is distributed in the combustion chamber as a function of the desired operating mode, stratified or homogeneous. If it is stratified, this means that an ignitable fuel-air mixture is essentially present only in the area of the spark plug. In this operating mode, the air feed to the combustion chamber is essentially completely unthrottled.

The use of piezoelectric actuators has the advantage that they make it possible to inject a desired fuel quantity with high precision. This applies in particular to very small injected fuel quantities, such as occur, for example, in a pilot injection or when larger injected fuel quantities are broken down into small single injections.

In order to inject fuel into a combustion chamber, an electrical charge is introduced into the piezoelectric actuator. This charge results in a change in the length of the piezoelectric actuator. A valve element of the fuel injection device and the piezoelectric actuator are normally coupled together via hydraulic amplification. To end the injection, the charge is again drained off the piezoelectric actuator. The piezoelectric actuators of the fuel injection devices of the particular combustion chambers or cylinders of an internal combustion engine are normally triggered by triggering an output stage located in a control unit. The control unit and the piezoelectric actuator are connected via leads which are detachably connected to the fuel injection device using connecting elements.

In a system of this type, it may occur that the piezoelectric actuator is triggered in such a way that the fuel injection device is opened and, due to a malfunction, it is simultaneously no longer possible to change the charge state of the piezoelectric actuator and thus to close the fuel injection device. As a consequence, fuel would be supplied to the corresponding cylinder without interruption, i.e., both during the combustion cycle and during the ejection of the hot exhaust gases, for example. However, this would result in serious damage to the internal combustion engine and to a catalytic converter of the internal combustion engine caused, for example, by a fuel knock.

Such an error may occur, for example, in the event of a cable rupture in the connection between the piezoelectric actuator and the control unit. Furthermore, this error may also occur if a defect occurs in the control unit. A defect of this type is present, for example, in a defective output stage switch. Further, an error of this type occurs when the plug connection on the control unit and/or on the piezoelectric actuator has become detached.

Such errors may be detected by the control unit. German Patent Application No. DE 198 54 306 describes an ohmic resistor connected in parallel to the piezoelectric actuator, via which the piezoelectric actuator may be discharged in a defined manner. Despite this measure, it has been determined, however, that it is not possible to rule out with absolute certainty that an amount of fuel such as to cause a fuel knock there will still enter the combustion chamber of the internal combustion engine. It is also not possible to completely rule out damage to the catalytic converter due to fuel entering the combustion chamber during the exhaust stroke, for example.

SUMMARY OF THE INVENTION

An object of the present invention is therefore to provide a method of the type stated above in such a way as to make it possible to rule out damage to the internal combustion engine and to the catalytic converter with maximum certainty if a malfunction of the piezoelectric actuator is detected.

In a method of the type specified above, this objective is attained by reducing the fuel mass flow to the fuel injection device if a malfunction of the piezoelectric actuator is detected.

The measure of the present invention prevents the continued supply of maximum fuel mass flow to the fuel injection device. Even if the valve element of the fuel injection device is still not in the closed position for a specific amount of time, this reduction of the fuel mass flow reduces the possible introduction of fuel into the combustion chamber of the internal combustion engine. However, the less fuel that still enters the combustion chamber assigned to the fuel injection device during a malfunction of the piezoelectric actuator, the less is the risk that, for example, a fuel knock will occur or that such a quantity of unburnt fuel will be transported to the catalytic converter that it may cause damage there.

It is provided that the fuel be delivered by at least one fuel pump into a high-pressure area to which the fuel injection device is connected and the pressure in the high-pressure area is reduced if a malfunction of the piezoelectric actuator is detected. Such a measure is possible within an extremely short response time. Since the fuel mass flow is a direct function of the pressure difference between the high-pressure area and the combustion chamber, the fuel mass flow may thus be reduced immediately after the malfunction is detected. If a pilot supply pump is present, the pressure in the high-pressure area of the fuel pump may be reduced to the pilot supply pressure or it may be reduced to ambient pressure.

It is preferred in particular that if a malfunction is detected, the piezoelectric actuator is brought into a safety position and the pressure in the high-pressure area is raised again to a normal level when the piezoelectric actuator is in the safety position. This makes it possible for the internal combustion engine to continue to be operated in an emergency operating mode using the combustion chambers whose fuel injection devices still operate normally. If the internal combustion engine is installed in a motor vehicle, for example, it may thus be driven to the next repair shop in an emergency operating mode.

The valve element of the fuel injection device may be brought out of an incorrectly opened position into a closed safety position in a simple manner by discharging the piezoelectric actuator. Such a discharge of the piezoelectric actuator is possible using, for example, the devices described in German Patent Application No. DE 198 54 306. Similar options are also described in German Patent Application No. DE 197 11 903. The content of both of these publications is therefore also expressly made an object of the present disclosure.

In a particularly advantageous embodiment of the present invention, the fuel connection to the fuel injection device is interrupted if a malfunction of the piezoelectric actuator is detected. This is possible, for example, by installing a shutoff valve between the high-pressure area and the fuel injection device. Such a complete interruption of the fuel connection to the fuel injection device ensures that even if the valve element of the fuel injection device is blocked in the opened position, no more fuel is able to enter the corresponding combustion chamber. The risk that this would result in damage to the internal combustion engine is thus particularly low.

The present invention also relates to a computer program which is suitable to implement the above method when it is executed on a computer. It is preferred in particular that the computer program is stored in a memory, a flash memory in particular or a ferrite RAM.

The present invention also relates to a control and/or regulating device for operating an internal combustion engine. In such a control and/or regulating device, it is preferred in particular that it include a memory in which a computer program of the above type is stored.

Furthermore, the present invention relates to an internal combustion engine having at least one fuel pump, having at least one fuel injection device, which injects the fuel directly into at least one combustion chamber of the internal combustion engine and the valve element of which is coupled to a piezoelectric actuator, and including means by which it is possible to detect a malfunction of the piezoelectric actuator.

To minimize the risk of damage to the internal combustion engine in the event of a fuel injection device blocked in opened position, it is provided that the internal combustion engine include means to reduce the fuel mass flow to the fuel injection device if a malfunction of the piezoelectric actuator is detected.

In an advantageous refinement, the internal combustion engine includes a high-pressure area which is connected to the fuel pump, the fuel injection device is connected to the high-pressure area and it includes a pressure control valve which may be used to influence the pressure in the high-pressure area.

In internal combustion engines having gasoline direct injection, the high-pressure area is generally a fuel collecting main, which is also known as a "rail," to which the fuel is delivered under high pressure by a high-pressure fuel pump. The pressure in the fuel collecting main is, in addition to other measures if necessary, adjusted by a pressure control valve. If a malfunction of a piezoelectric actuator of a fuel injection valve is reported, the pressure in the high-pressure area may be immediately relieved via the pressure control valve.

The advantages of the present invention are thus attainable without it being necessary to install additional components. The pressure reduction in the high-pressure area may also be supported by interrupting the supply of fuel from the fuel pump to the high-pressure area. This may be implemented easily by triggering a normally available volume control valve.

It is also advantageous if the internal combustion engine includes a valve device that may be used to interrupt the fuel connection to the fuel injection device. Such a valve device may be situated, for example, between the high-pressure area and the fuel injection device. In particular, it offers a high level of safety against damage to the internal combustion engine if a piezoelectric actuator is at least temporarily blocked in opened position.

It is further preferred that the internal combustion engine include a device that may be used to drain off an electrical charge stored in the piezoelectric actuator if a malfunction of the piezoelectric actuator is detected. Reference is also made to German Patent Application Nos. DE 198 54 306 and DE 197 11 903 in this regard.

In particular, a refinement of the internal combustion engine according to the present invention is preferred in which the internal combustion engine includes a control and/or regulating device of the above-described type.

DETAILED DESCRIPTION

Figure 1:
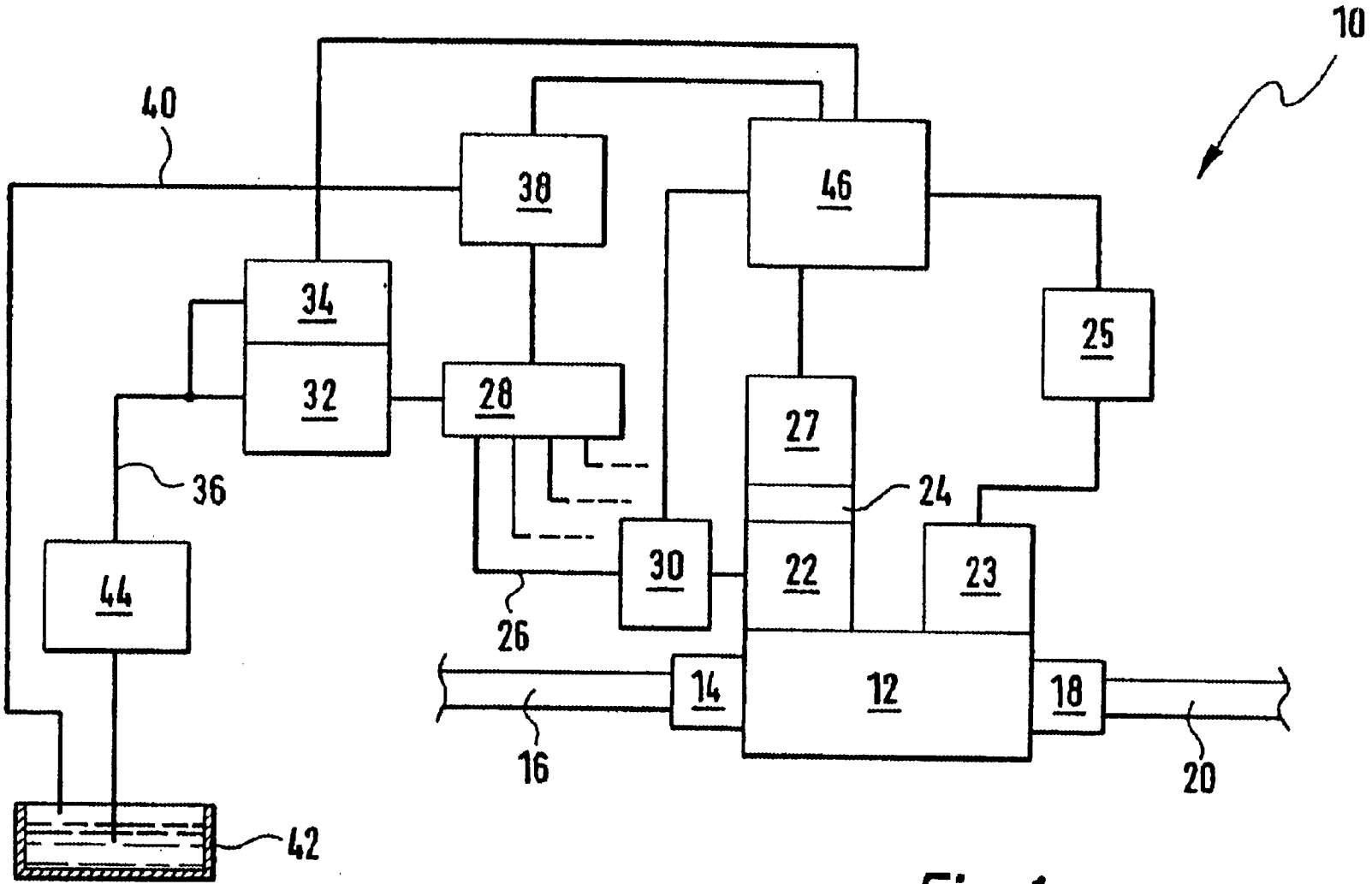
FIG. 1 shows a schematic diagram of an internal combustion engine having a fuel injection device, which in turn has a piezoelectric actuator.

An internal combustion engine has the overall reference numeral 10 in FIG. 1. It includes a plurality of combustion chambers, of which only one is shown in FIG. 1 using reference symbol 12. Combustion air is fed to the combustion chamber via an intake valve 14 and an intake manifold 16. The combustion gases are carried off from combustion chamber 12 via an exhaust valve 18 and an exhaust pipe 20.

Fuel is supplied to combustion chamber 12 via a fuel injection device 22 situated directly on combustion chamber 12. The fuel-air mixture present in combustion chamber 12 is ignited by a spark plug 23, which is connected to an ignition system 25. Fuel injection device 22 includes a piezoelectric actuator 24, which is coupled to a valve element (not shown) of fuel injection device 22. An ohmic resistor 27 is connected to piezoelectric actuator 24. Fuel injection device 22 is connected to a fuel collecting main 28 (rail) via a high-pressure fuel line 26. A shutoff valve 30 is situated in high-pressure fuel line 26 between fuel collecting main 28 and fuel injection device 22.

A high-pressure fuel pump 32 supplies the fuel to fuel collecting main 28. In normal operation of internal combustion engine 10, the fuel is accumulated at high pressure in fuel collecting main 28. A volume control valve (34) sets the quantity of fuel supplied. This may take place during a delivery stroke of high-pressure fuel pump 32, whose working space (not shown) is connected to a low-pressure fuel line 36. During the time volume control valve 34 is open, no fuel enters fuel collecting main 28 from high-pressure fuel pump 32. The pressure in fuel collecting main 28 is set by a pressure control valve 38. Pressure control valve 38 is connected to a fuel tank 42 via a return line 40. An electric fuel pump 44 delivers the fuel from fuel tank 42 into low-pressure fuel line 36 and further to high-pressure fuel pump 32.

Internal combustion engine 10 also includes a control and regulating device 46, which controls fuel injection device 22, ignition system 25, shutoff valve 30, volume control valve 34, and pressure control valve 38. The operation of internal combustion engine 10 is controlled by the control and regulating device according to the method shown in FIG. 2. It is stored as a computer program in control and regulating device 46.

The method commences in a starting block 48. In block 50, the function of piezoelectric actuator 24 is monitored. In doing so, malfunctions of piezoelectric actuator 24 may be detected. Such malfunctions include, for example, a break of the connection between piezoelectric actuator 24 and control and regulating device 46. A defect in the control unit itself, which may result in a malfunction of piezoelectric actuator 24 is also detected in block 50.

A malfunction of piezoelectric actuator 24 may be detected in block 50, for example, by regularly measuring the discharge current of piezoelectric actuator 24 when closing. If the connection between piezoelectric actuator 24 and control and regulating device 46 is interrupted by, for example, a cable rupture or by a disconnected cable, the measured discharge current is zero so that the resulting malfunction of piezoelectric actuator 24 is detectable immediately.

If a malfunction of piezoelectric actuator 24 is detected, three actions are taken concurrently. Shutoff valve 30 is closed (block 52). An electrical charge that may still be stored in piezoelectric actuator 24 is drained off via ohmic resistor 27 (block 54). Finally, pressure control valve 38 and volume control valve 34 are triggered in block 56 in such a way that the pressure in fuel collecting main 28 drops abruptly.

As can be seen in FIGS. 3–6, these actions bring about a high degree of safety against unintended introduction of fuel into combustion chamber 12 in the event of a malfunction of piezoelectric actuator 24. As is evident from FIG. 4, a specific amount of time is required until the charge is drained off from piezoelectric actuator 24 (see FIG. 4). This is related to the fact that ohmic resistor 27 must be designed in such a way that in normal operation of internal combustion engine 10 without malfunction of piezoelectric actuator 24, it is possible to build up the charge in piezoelectric actuator 24 fast enough that a correspondingly rapid activation of piezoelectric actuator 24 and the valve element coupled to it is possible.

Figure 5:
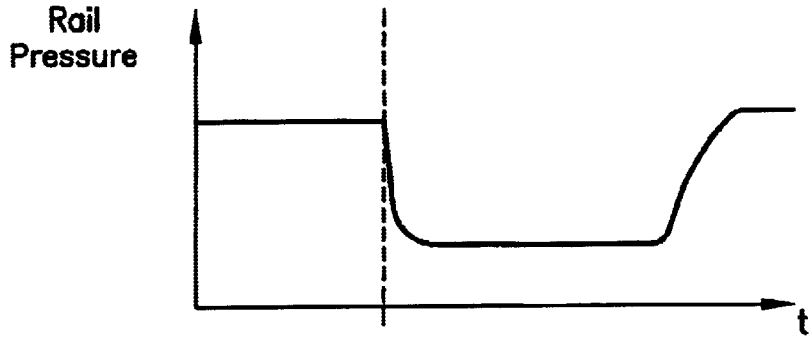
FIG. 5 shows a diagram in which the pressure in a fuel collecting main of the internal combustion engine of FIG. 1 is shown over time.
Figure 6:
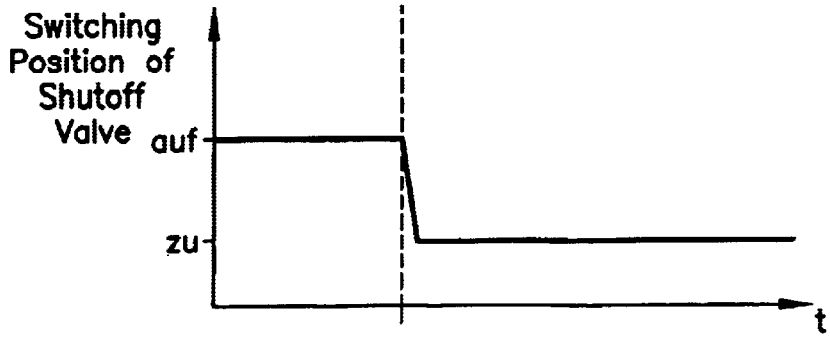
FIG. 6 shows a diagram in which the position of a shutoff valve of the internal combustion engine of FIG. 1 is shown over time.

As can be seen in FIG. 5, the triggering of volume control valve 34 and of pressure control valve 38 makes it possible to reduce the pressure in fuel collecting main 28 within a span of time that is significantly shorter than the time required to reduce the charge in piezoelectric actuator 24. Thus, even if the charge is not yet completely drained off from piezoelectric actuator 24 and the valve of fuel injection device 22 is thus still not completely closed, it is ensured that only a slight amount of fuel, if any, is able to enter combustion chamber 12 of internal combustion engine 10. This is further supported by the closing of shutoff valve 30 (FIG. 6), which completely interrupts the supply of fuel to fuel injection device 22. In the present exemplary embodiment, the reduction of the fuel mass flow to fuel injection device 22 is thus redundant.

Figure 2:
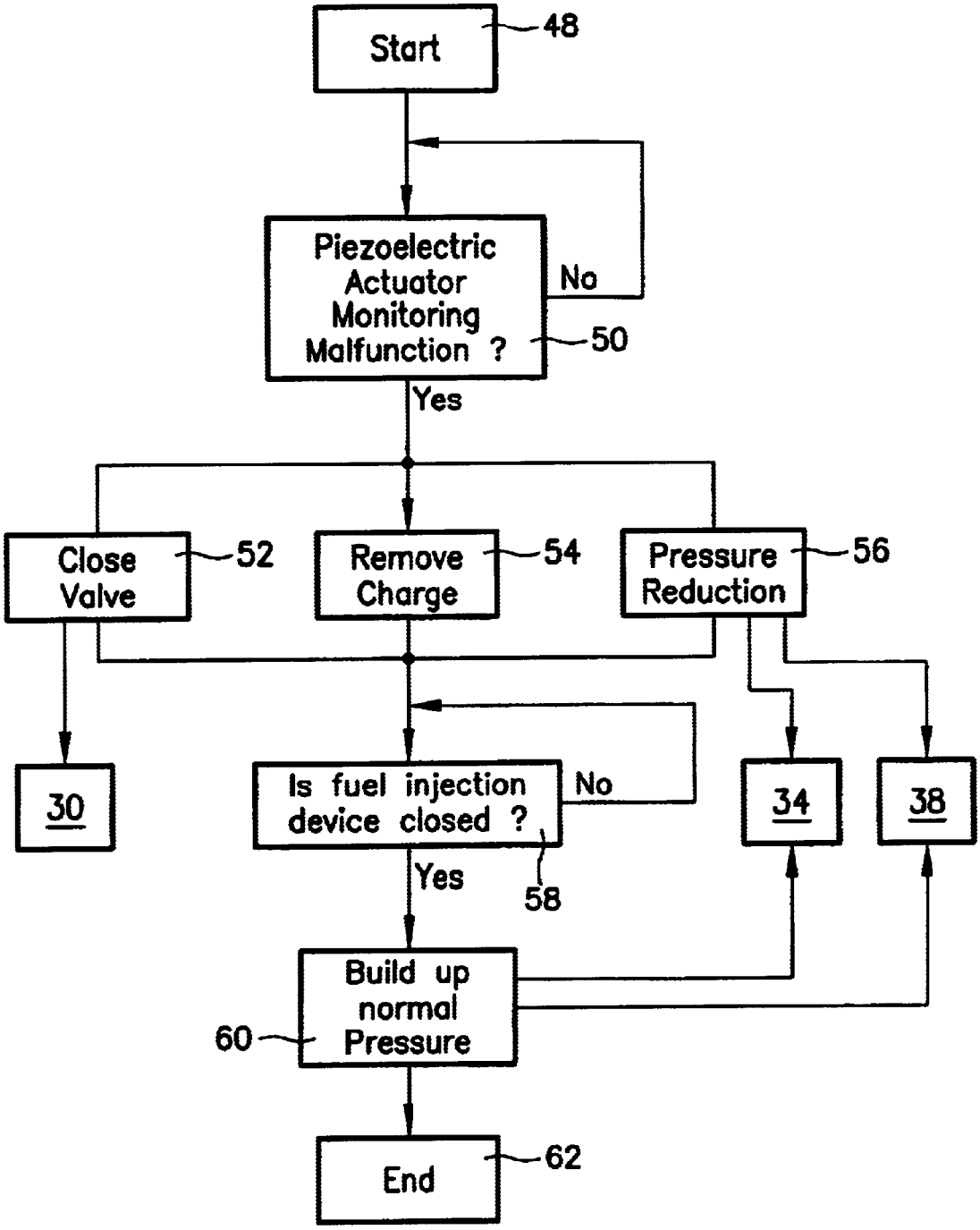
FIG. 2 shows a flowchart which describes a method for operating the internal combustion engine of FIG. 1.
Figure 3:
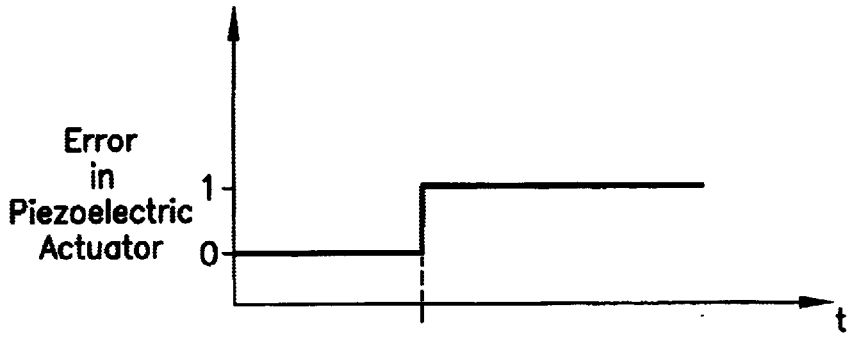
FIG. 3 shows a diagram in which a fault condition of the piezoelectric actuator of the fuel injection device of the internal combustion engine of FIG. 1 is plotted over time.
Figure 4:
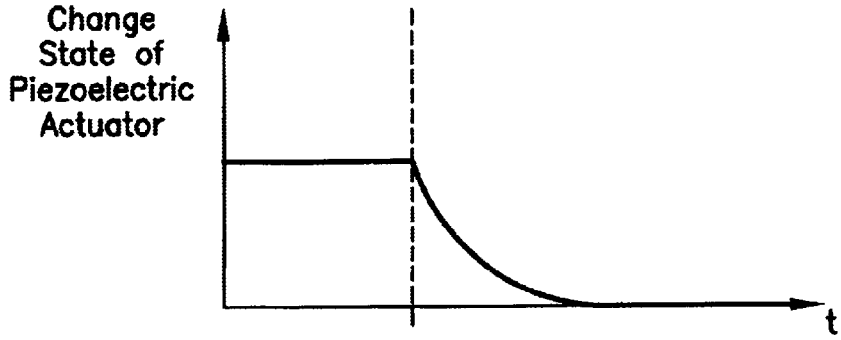
FIG. 4 shows a diagram in which the charge state of the piezoelectric actuator of the fuel injection device of the internal combustion engine of FIG. 1 is shown over time.

In FIG. 2, a check is performed in block 58 whether fuel injection device 22 is completely closed. Knowledge of the discharge curve of FIG. 4 makes it possible, for example, to assume after a specific lapse of time that piezoelectric actuator 24 is completely discharged and the valve element of fuel injection device 22 is in the completely closed position. If the answer in block 58 is "yes", volume control valve 34 and pressure control valve 38 are again triggered in block 60 in such a way that the normal operating pressure is built up in fuel collecting main 28 (see FIG. 5). The method ends in an end block 62.

When fuel injection device 22 is in the closed position, the rapid recovery of pressure in fuel collecting main 28 makes it possible to continue to operate internal combustion engine 10 in an emergency operating mode. In this case, the fuel injection devices of the other combustion chambers (not shown in FIG. 2) may of course continue to be operated as long as no malfunction is detected in them.

It is understood that the actions completed in blocks 52 and 56 in FIG. 2 (closing shutoff valve 30 and reducing the pressure in fuel collection main 28) are not both absolutely necessary to reduce the risk of damage to internal combustion engine 10 in the event of a malfunction of piezoelectric actuator 24. In exemplary embodiments not shown, it is also possible to perform only one of these two actions.

What is claimed is:

1. A method for operating an internal combustion engine in which fuel directly enters at least one combustion chamber of the engine via at least one fuel injection device whose valve element is moved by a piezoelectric actuator, the method comprising:

monitoring a function of the piezoelectric actuator and detecting a malfunction of the piezoelectric actuator;

reducing a fuel mass flow to the fuel injection device if a malfunction is detected;

delivering the fuel by at least one fuel pump into a high-pressure area to which the fuel injection device is connected and reducing a pressure in the high-pressure area if a malfunction is detected; and if a malfunction is detected, bringing the piezoelectric actuator into a safety position and raising again to a normal level the pressure in the high-pressure area when the piezoelectric actuator is in the safety position.

2. The method according to claim 1, further comprising bringing the valve element of the fuel injection device out of an incorrectly opened position into a closed safety position by discharging the piezoelectric actuator.

3. The method according to claim 1, further comprising interrupting a fuel connection to the fuel injection device if a malfunction is detected.

4. A computer program on a tangible medium for implementing, when executed on a computer, the following method for operating an internal combustion engine in which fuel directly enters at least one combustion chamber of the engine via at least one fuel injection device whose valve element is moved by a piezoelectric actuator:

monitoring a function of the piezoelectric actuator and detecting a malfunction of the piezoelectric actuator;

reducing a fuel mass flow to the fuel injection device if a malfunction is detected;

delivering the fuel by at least one fuel pump into a high-pressure area to which the fuel injection device is connected and reducing a pressure in the high-pressure area if a malfunction is detected; and if a malfunction is detected, bringing the piezoelectric actuator into a safety position and raising again to a normal level the pressure in the high-pressure area when the piezoelectric actuator is in the safety position.

5. The computer program according to claim 4, wherein the computer program is stored in a memory.

6. The computer program according to claim 5, wherein the memory is a flash memory.

7. The computer program according to claim 5, wherein the memory is a ferrite RAM.

8. A control/regulating device for operating in an internal combustion engine in which fuel directly enters at least one combustion chamber of the engine via at least one fuel injection device whose valve element is moved by a piezoelectric actuator, the control/regulating device comprising a memory for storing a computer program for implementing the following method:

monitoring a function of the piezoelectric actuator and detecting a malfunction of the piezoelectric actuator;

reducing a fuel mass flow to the fuel injection device if a malfunction is detected;

delivering the fuel by at least one fuel pump into a high-pressure area to which the fuel injection device is connected and reducing a pressure in the high-pressure area if a malfunction is detected; and if a malfunction is detected, bringing the piezoelectric actuator into a safety position and raising again to a normal level the pressure in the high-pressure area when the piezoelectric actuator is in the safety position.

9. An internal combustion engine comprising:

at least one fuel pump;

at least one combustion chamber;

a piezoelectric actuator;

at least one fuel injection device which injects fuel directly into the at least one combustion chamber, the fuel injection device including a valve element coupled to the piezoelectric actuator;

means for detecting a malfunction of the piezoelectric actuator; and a control/regulating device including a memory for storing a computer program for implementing the following method:

reducing a fuel mass flow to the fuel injection device if a malfunction is detected;

delivering the fuel by the at least one fuel pump into a high pressure area to which the fuel injection device is connected and reducing a pressure in the high-pressure area if a malfunction is detected; and if a malfunction is detected, bringing the piezoelectric actuator into a safety position and raising again to a normal level the pressure in the high-pressure area when the piezoelectric actuator is in the safety position.

* * * * *

UNITED STATES PATENT AND TRADEMARK OFFICE

CERTIFICATE OF CORRECTION

PATENT NO. : 6,918,379 B2
APPLICATION NO. : 10/491404
DATED : July 19, 2005
INVENTOR(S) : Reischl et al.

It is certified that error appears in the above-identified patent and that said Letters Patent is hereby corrected as shown below:

Column 8, lines 15-16, change "a memory for storing" to -- a memory storing --

Signed and Sealed this

Eighth Day of April, 2008

JON W. DUDAS
*Director of the United States Patent and Trademark Office*